US011655815B2

(12) United States Patent
Brasselle et al.

(10) Patent No.: US 11,655,815 B2
(45) Date of Patent: May 23, 2023

(54) SEMI-RIGID STATOR

(71) Applicant: Roper Pump Company, Commerce, GA (US)

(72) Inventors: Trevor Mark Brasselle, Senoia, GA (US); Brian Lee Gerdes, Dacula, GA (US); Gregory Richard Ferguson, Gillsville, GA (US); Cody Richard Reynolds, Covington, GA (US)

(73) Assignee: ROPER PUMP COMPANY, LLC, Wilmington, DE (US)

( * ) Notice: Subject to any disclaimer, the term of this patent is extended or adjusted under 35 U.S.C. 154(b) by 184 days.

(21) Appl. No.: 17/120,803

(22) Filed: Dec. 14, 2020

(65) Prior Publication Data

US 2021/0180593 A1 Jun. 17, 2021

Related U.S. Application Data

(60) Provisional application No. 62/947,612, filed on Dec. 13, 2019.

(51) Int. Cl.

| | |
|---|---|
| ***F01C 21/10*** | (2006.01) |
| ***F04C 2/107*** | (2006.01) |
| *F01C 1/10* | (2006.01) |

(52) U.S. Cl.

CPC ..... *F04C 2/1075* (2013.01); *F01C 21/104* (2013.01); *F01C 1/101* (2013.01); *F04C 2240/10* (2013.01); *F04C 2240/20* (2013.01); *F04C 2240/70* (2013.01)

(58) Field of Classification Search

CPC ..... F01C 21/104; F01C 1/101; F04C 2/1075; F05B 2240/10

See application file for complete search history.

(56) References Cited

U.S. PATENT DOCUMENTS

| | | | | |
|---|---|---|---|---|
| 4,144,001 | A | 3/1979 | Streicher | |
| 5,171,138 | A * | 12/1992 | Forrest | F01C 1/101 418/83 |
| 5,807,087 | A | 9/1998 | Brandt et al. | |
| 5,832,604 | A | 11/1998 | Johnson et al. | |
| 7,396,220 | B2 | 7/2008 | Delpassand et al. | |
| 8,967,985 | B2 | 3/2015 | Coghlan, III et al. | |

(Continued)

FOREIGN PATENT DOCUMENTS

| | | | |
|---|---|---|---|
| EP | 1596486 | A2 | 11/2005 |
| GB | 1567880 | A | 5/1980 |

(Continued)

*Primary Examiner* — Deming Wan

(74) *Attorney, Agent, or Firm* — Snyder, Clark, Lesch & Chung, LLP

(57) ABSTRACT

A semi-rigid stator is provided for a helical gear device. The stator includes a stack of rigid rings, a deformable layer, and a rigid housing. Each of the rigid rings has a central opening and an exterior surface. The rigid rings are aligned along a common centerline and rotated slightly relative to each other such that the stack of rigid rings forms a helically convoluted chamber. Each of the rigid rings is secured within the rigid stator housing by the deformable layer disposed between the exterior surface of each of the rigid rings and the rigid housing. The deformable layer bonds the rigid rings together as the ring stack and permits movement of the rigid rings relative to each other.

18 Claims, 12 Drawing Sheets

(56) References Cited

U.S. PATENT DOCUMENTS

| | | | |
|---|---|---|---|
| 9,803,636 | B2 | 10/2017 | Rothschild et al. |
| 2005/0106052 | A1 | 5/2005 | Jager et al. |
| 2011/0058930 | A1 | 3/2011 | Belcher |
| 2015/0184654 | A1 | 7/2015 | Twidale et al. |
| 2016/0348508 | A1 | 12/2016 | Purcell et al. |
| 2018/0119697 | A1* | 5/2018 | Coghlan ..... F04C 2/1075 |

FOREIGN PATENT DOCUMENTS

| | | | |
|---|---|---|---|
| RU | 2073094 | C1 | 2/1997 |
| RU | 2318135 | C1 | 2/2008 |
| RU | 2380544 | C1 | 1/2010 |

* cited by examiner

SEMI-RIGID STATOR

CROSS-REFERENCE TO RELATED APPLICATION

This application claims priority under 35 U.S.C. § 119, based on U.S. Provisional Patent Application No. 62/947,612, filed on Dec. 13, 2019 and titled "Semi-Rigid Stator," the disclosure of which is hereby incorporated by reference.

BACKGROUND OF THE INVENTION

The present invention relates to progressing cavity devices, and more particularly to stators of progressing cavity devices that can pass fluids containing solids.

Progressing cavity pumps are frequently used in applications to handle highly viscous fluids and fluids containing solids. Depending on the size and shape of the solids, the solids can get jammed between the rotor and stator and cause the pump to lock up.

DETAILED DESCRIPTION OF THE PREFERRED EMBODIMENTS

The following detailed description refers to the accompanying drawings. The same reference numbers in different drawings may identify the same or similar elements.

There are two common types of progressive cavity pump stators. One type is a deformable, elastomer-lined stator. The other type is a ridged, non-deformable stator.

Elastomer-lined stators can be damaged if sharp solids (such as rocks and debris) pass through the pump, if the pump is run dry, where there are extreme temperatures or corrosive chemicals, etc. Thus, rigid stators may be preferred for applications with highly viscous fluids and fluids containing solids.

Depending on the size and shape of the solids, the solids can get jammed between the rotor and the rigid stator and cause the pump to lock up. This can cause significant damage to the pump depending on the hardness and size of the solid. Furthermore, even small solids can cause rapid abrasive wear to the stator, rotor, or both.

Rigid stators are currently expensive to manufacture with extensive processing time and wasted material. The geometry as well as manufacturing processes limit the materials that the stator can be made from. This limitation prohibits use of materials and coatings that would aid in abrasion resistance.

According to an implementation described herein, a semi-rigid stator is provided. The stator includes rigid rings, a non-rigid layer, and a rigid tube. The rigid rings are stacked along a helix. The combination of the ring profile and the helix form the inner profile of the stator. The ring stack is bonded to an outer tube by a non-rigid (e.g., flexible, deformable) layer. By suspending the rigid rings in the non-rigid layer the rings are allowed to move relative each other and the rigid tube.

The flexibility of the non-rigid layer enhances the performance of the stator. More particularly, as a large solid passes through the pump, the rigid rings are able to move radially, preventing the pump from locking up. After the solid passes, the rigid rings are pulled back into place by the non-rigid layer. The ring movement prevents the high stress concentrations seen in a conventional rigid stator.

Furthermore, abrasion resistance is improved using the semi-rigid stator. In the case of small particles through a conventional rigid stator, a particle is typically forced between the rigid rotor and the rigid stator, which creates forced abrasion in the stator. Implementations described herein allow for a dynamic change in radial spacing between the stator and the rotor, which limits forced abrasion. The dynamic radial spacing also allows for new materials to be used in the stator that are not possible in a conventional stator. Such new materials can greatly increase abrasion resistance.

Figure 1:
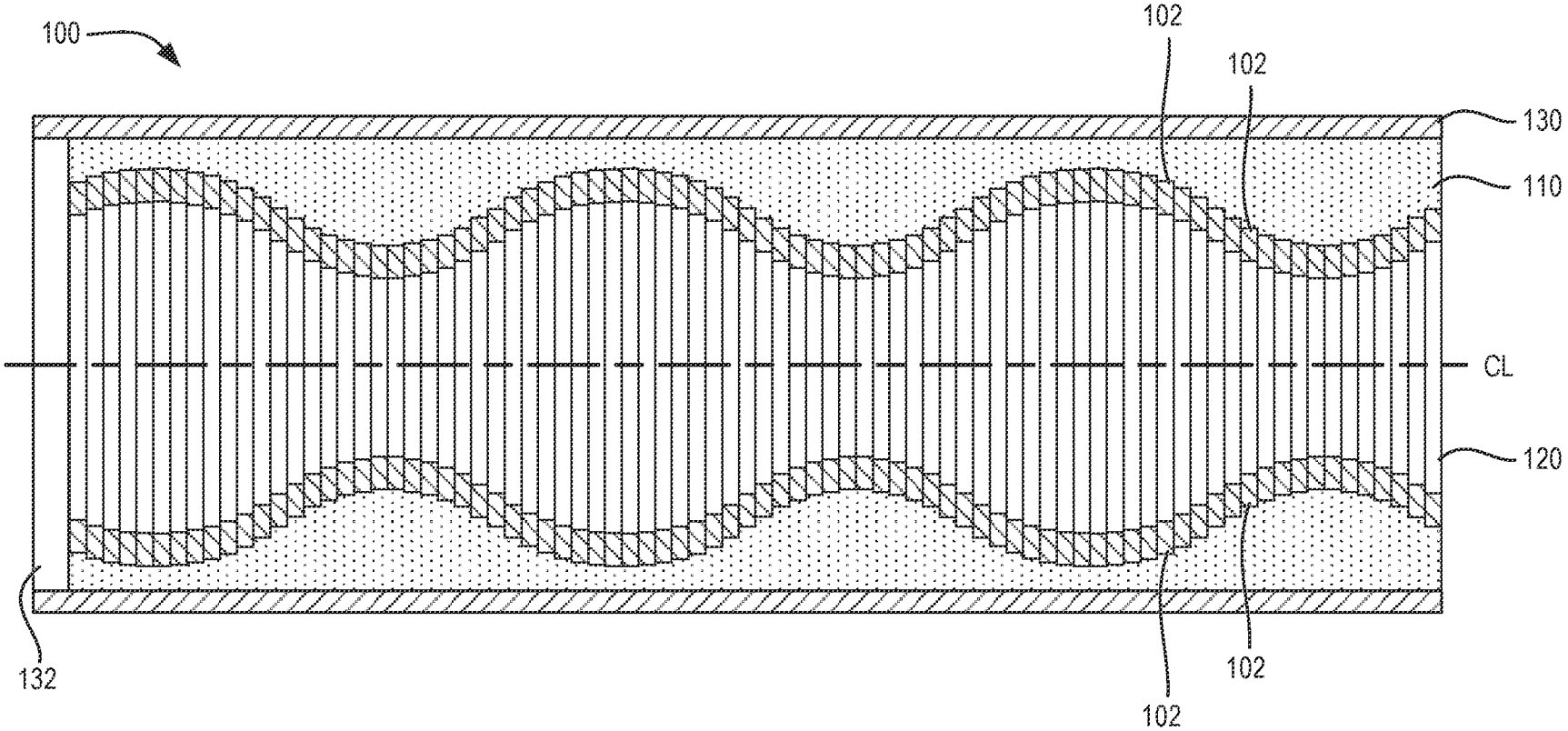
FIG. 1 is a longitudinal cross-section view of a portion of a semi-rigid stator.
Figure 2:
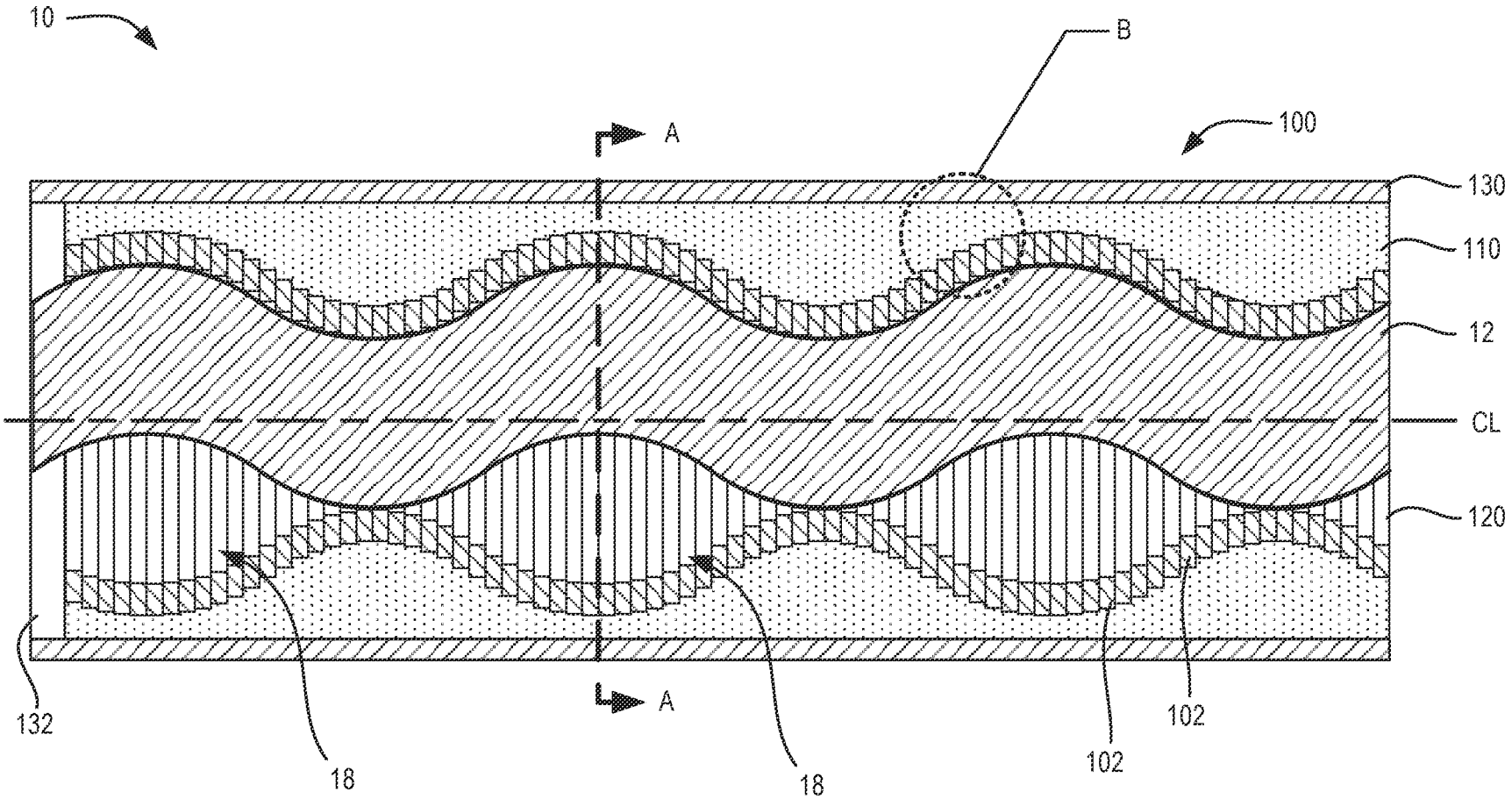
FIG. 2 is a longitudinal cross-section view of the portion of the semi-rigid stator of FIG. 1 with a pump rotor disposed therein.
Figure 3:
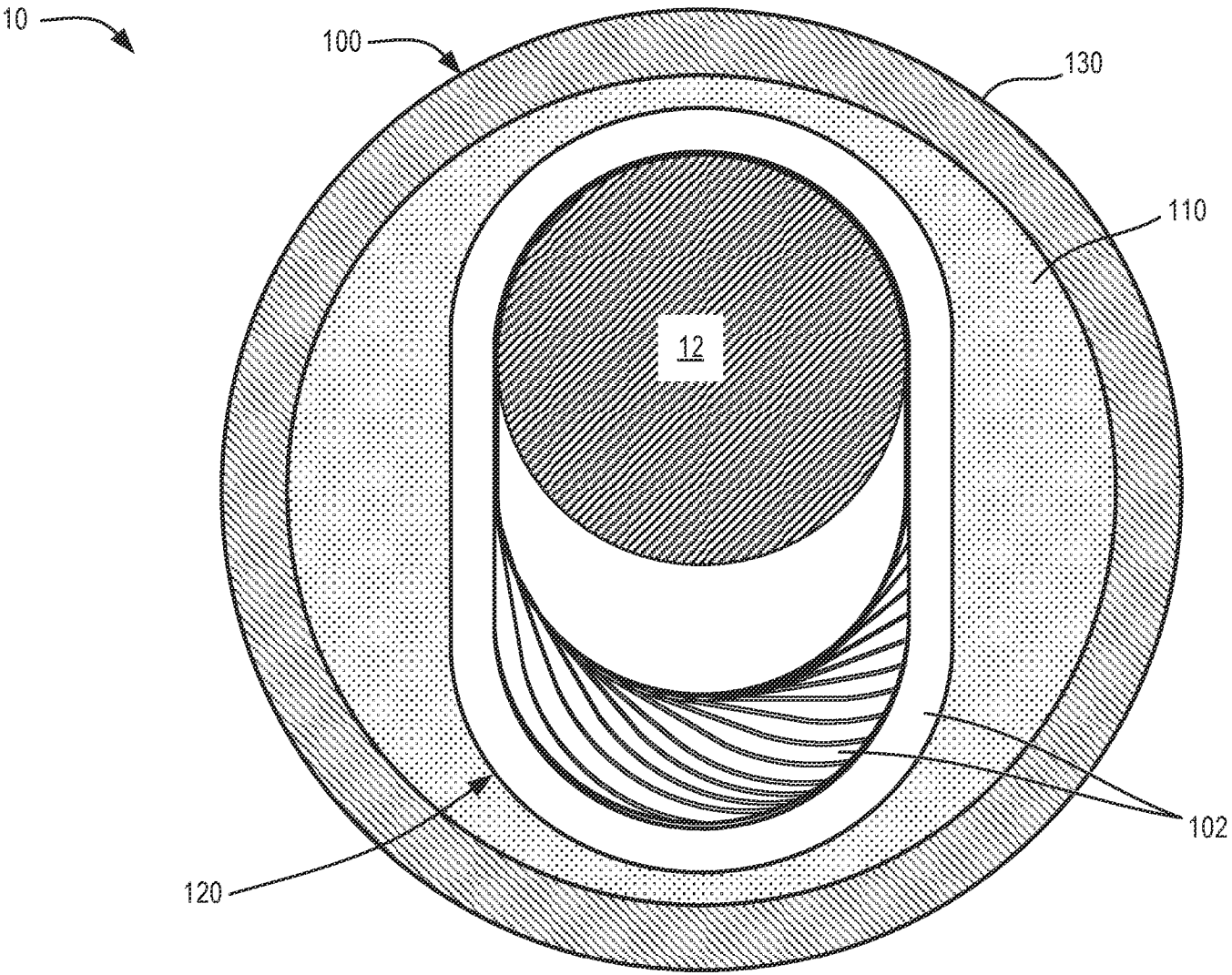
FIG. 3 is a cross-sectional end view of the semi-rigid stator and rotor of FIG. 2.

FIG. 1 depicts a partial, longitudinal cross-sectional view of an exemplary semi-rigid stator section 100. In FIG. 2, a pump section 10 is shown with an elongated helically lobed rotor 12 extended through stator 100. FIG. 3 is a cross-sectional end view of pump section 10. In one implementation, stator section 100 and rotor 12 may correspond to a progressive cavity pump section. Stator section 100 is a helically lobed structure preferably having at least one more lobe than the rotor 12. In the configuration of FIGS. 2 and 3, for example, pump section 10 is part of a helical gear pump including an internal gear (stator section 100) with a double lobe and an external gear (rotor 12) with a single lobe (e.g., a circular transverse cross-section). The meshing of stator section 100 and rotor 12 forms a cavity 18, which progresses along the axis (e.g., centerline CL) of stator section 100 as rotor 12 is rotated.

Stator section 100 may include multiple like-shaped rigid rings 102 (referred to herein as "rigid rings 102" or "stator rings 102") secured to a tubular housing 130 by a non-rigid material 110 (also referred to herein as a "deformable layer"). As can best be seen in FIGS. 4A-4D, each rigid ring 102 includes a central opening 104 with an exemplary ring 102 having two symmetrical lobes 103 radially extending toward centerline CL. As shown, for example in FIG. 4B, opening 104 may thus be in the form of a rectangle with a semi-circle added at opposite ends, where the size of the rectangular separation between the semicircles is proportional to the offset (or eccentricity) of rotor 12. In one implementation, all of rigid rings 102 have substantially identical construction and dimension.

As shown in FIG. 1, rigid rings 102 may be stacked together to form a helically convoluted chamber or passageway 120 for stator section 100. In the stacked configuration, each of rigid rings 102 may be aligned along a common centerline (CL) with each ring being rotated slightly from the rings on either side (e.g., creating a small angular difference between the rings such that the adjacent openings 104 form a helical winding inside tubular housing 130.

Rigid rings 102 may be formed into the helical passageway 120 of stator section 100, for example, by stacking rigid rings 102 onto an alignment assembly, including an alignment mandrel/core with a profile that matches lobes 103 of rigid rings 102 with its profile cut in a helical pattern in the alignment core. Rigid rings 102 may also be aligned with an alignment assembly including a jig which interacts with ring features other than the inner profile or through features built into rigid rings 102 (e.g., grooves on an exterior surface or apertures through a ring surface) that rotate each ring slightly relative to neighboring rigid rings 102.

Figure 4A:
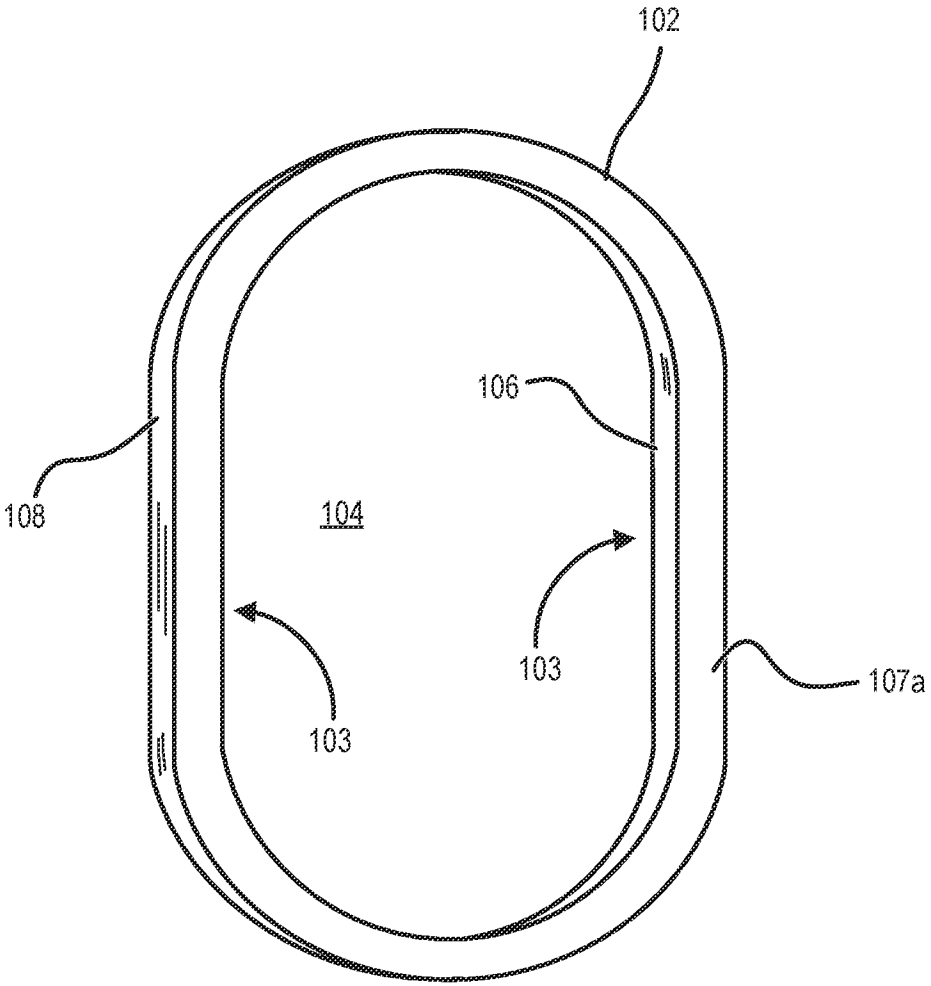
FIG. 4A is a perspective end view of an exemplary stator ring, according to an implementation described herein.
Figure 4D:
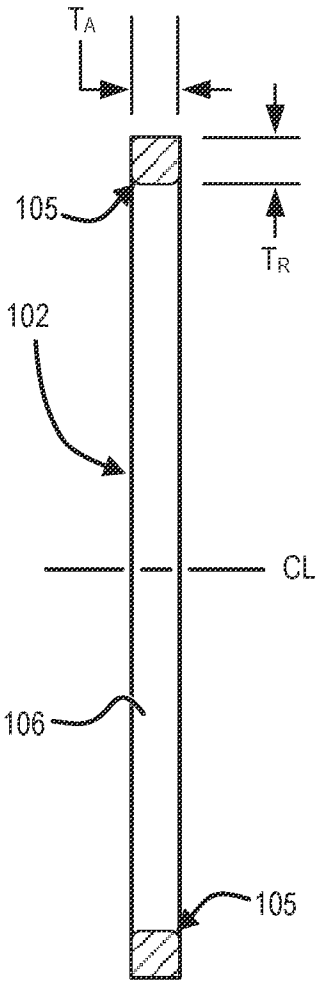
FIGS. 4B-4D are end, side, and side cross-section views of the stator ring of FIG. 4A.
Figure 4C:
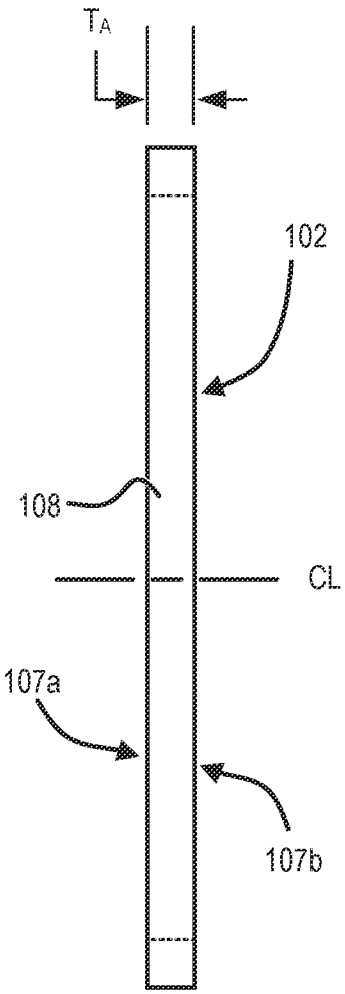
Figure 4B:
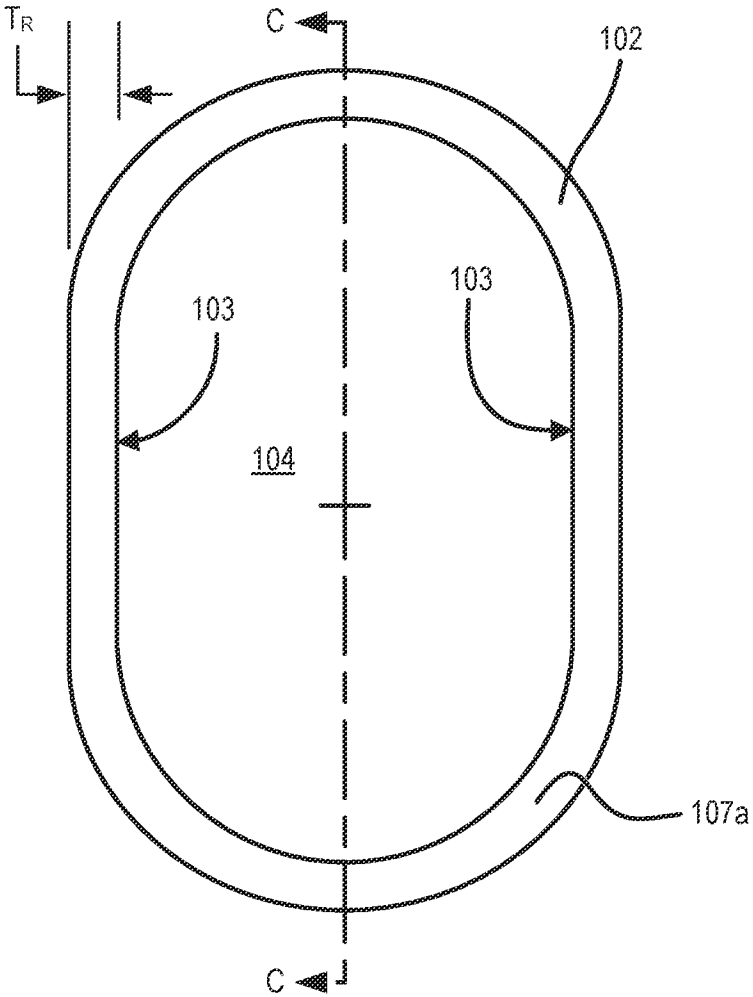

As shown, for example, in FIGS. 4A-4D, each of rigid rings 102 may include a front side surface 107*a* and a rear side surface 107*b* (referred to collectively as "sides 107" or generically as "side 107") extending along a perimeter of opening 104. In one implementation, front side surface 107*a* and rear side surface 107*b* may define parallel planes, with an interior surface 106 and an exterior surface 108 of ring 102 being perpendicular to each of front side surface 107*a* and rear side surface 107*b* along the entire perimeter. According to another implementation, interior surface 106 and sides 107 may connect at rounded edges 105, as shown in the example of FIG. 4D. Rounded edges 105 may help solids to more easily pass between rotor 12 and interior surface 106, as described further herein.

Each of rigid rings 102 may have an axial thickness, $T_A$, which also defines a depth of the opening 104 through each rigid ring 102. Interior surface 106 along opening 104 extends in the convoluted shape for the thickness $T_A$ when measured in a direction parallel to the common centerline. The thickness of the rigid rings determines the size of the step between sides 107 as they are aligned into the desired helical formation of passageway 120. Thicker rings may provide larger steps.

Figure 10B:
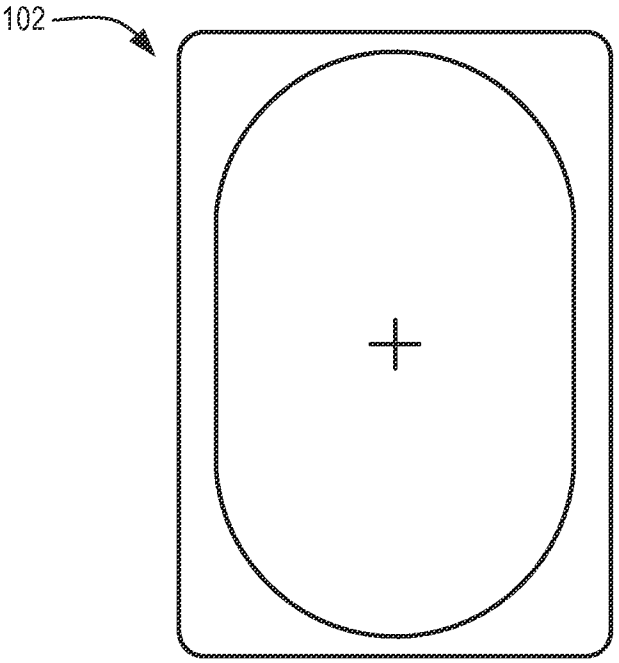
FIGS. 10A and 10B are end views of other exemplary stator rings, according to implementations described herein.
Figure 10A:
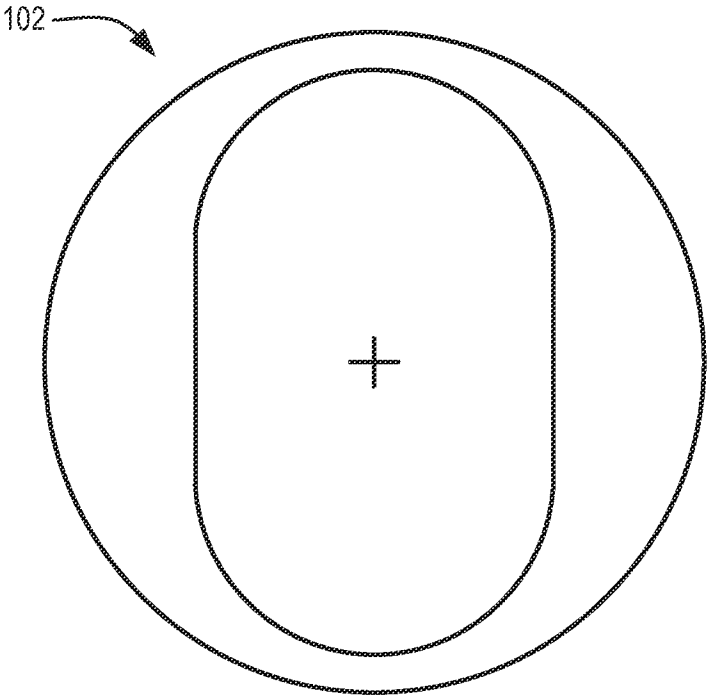

Each of rigid rings 102 may also have a radial thickness, $T_R$, which defines a distance between interior surface 106 and exterior surface 108 on each rigid ring 102. While radial thickness $T_R$ is shown as generally uniform in the illustrated examples, in other implementations, radial thickness $T_R$ may vary along a rigid ring. For example, exterior surface 108 may form a circular, rectangular, or irregular shaped perimeter of ring 102 that would provide non-uniform radial thicknesses at different parts of ring 102. FIGS. 10A and 10B provide end view illustrations of rigid rings 102 with non-uniform radial thicknesses.

Each of thicknesses $T_A$ and $T_R$ may be sized to resist deformation (bending) of rigid rings 102. Each of thicknesses $T_A$ and $T_R$ may be sized based on a type of material used, accounting for strength of material, material hardness, etc. According to an implementation, thickness $T_A$ may be in the range of about 0.05 inches to 0.50 inches (1.27 mm to 12.7 mm) or more. In one example, thickness $T_A$ may be about 0.10 inches (2.54 mm). Thickness $T_R$ may be in the range of about 0.05 inches to 1 inch (1.27 mm to 25.4 mm) or more. In one example, thickness $T_R$ may be at least about 0.06 inches (1.5 mm). In some implementations, rigid rings 102 with optimized thicknesses $T_A$ and $T_R$ for a particular application may use less rigid material and provide cost savings over stacked disk-shaped structures.

Rigid rings 102 may be manufactured in a variety of ways, with preferred methods including machining via laser, water jet, electrical discharge machining (EDM), milling etc. or a stamping/punching process. They may also be made to shape originally by casting, powder metallurgy or any similar process. In one implementation, rigid rings 102 may be formed from metal, such as a hardened tool steel from one of the American Iron and Steel Institute (AISI) grades of tool steel. In other implementations, a different material, such as ceramic, may be used to form rigid rings 102. A primary factor behind the method of ring manufacture is the ring material and the cost of manufacture for that material. For example, stamping is cost effective for some rings made of metals but unfeasible for rings made of ceramics.

Figure 5B:
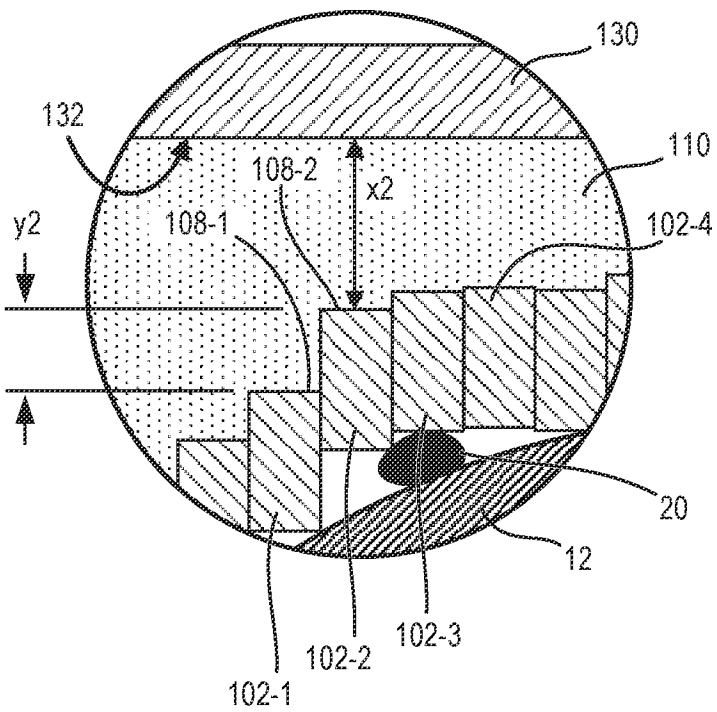
FIGS. 5A and 5B are an enlarged views of a portion of the stator of FIG. 1 showing relative movement between the stator rings.
Figure 5A:
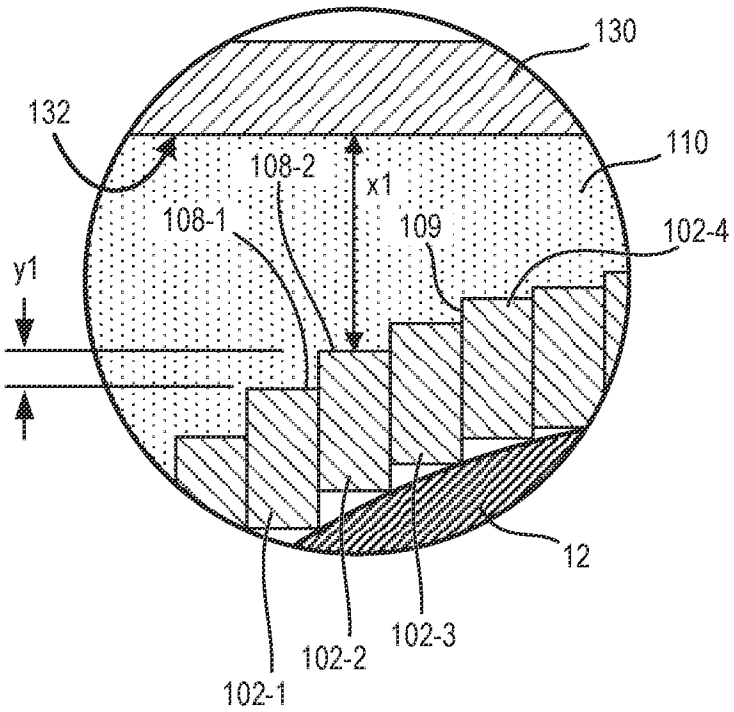
Figure 6:
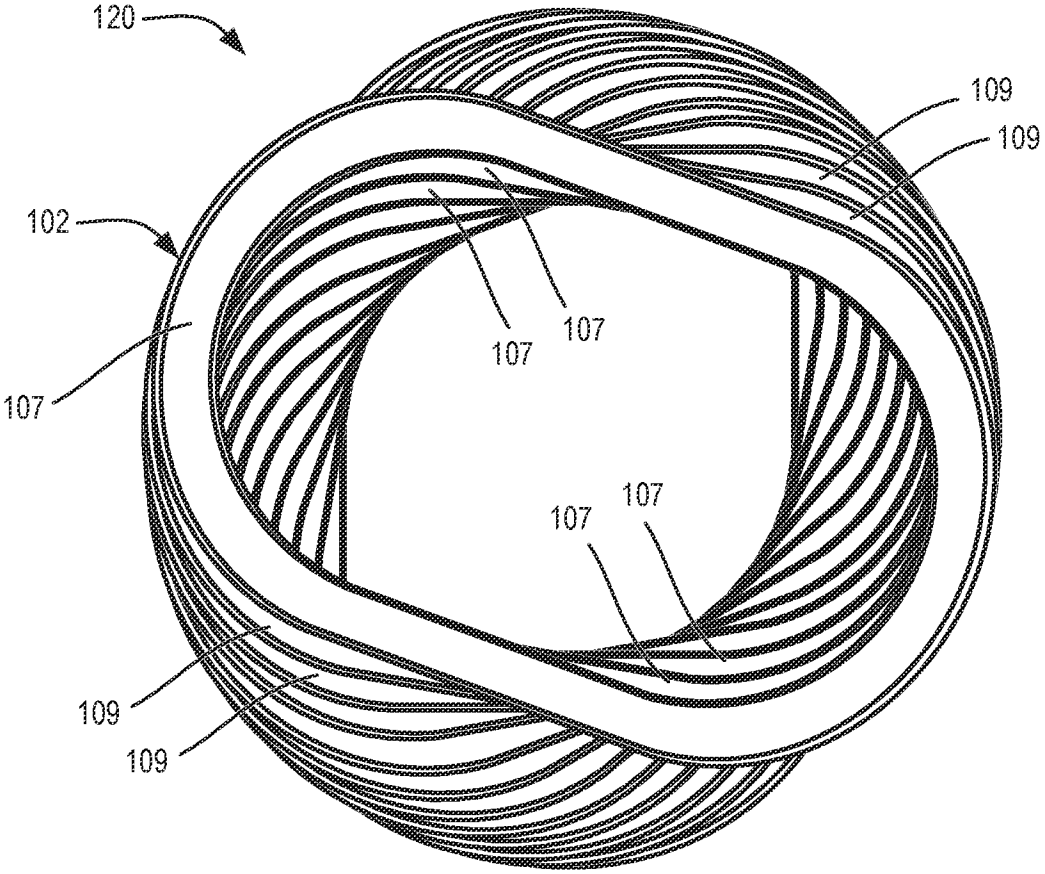
FIG. 6 is a front perspective view of a portion of the helical passageway of FIG. 1.

FIGS. 5A and 5B are enlarged views of a portion "B" of FIG. 2. FIG. 6 is a front perspective view of a portion of helical passageway 120. As shown in FIGS. 5A and 5B, rings 102 are secured to tubular housing 130 by non-rigid material 110. Non-rigid material 110 may hold rigid rings 102 in the structure of helical passageway 120 in stator section 100. Non-rigid material 110 may bond to both rigid rings 102 and tubular housing 130. More particularly, non-rigid material 110 may adhere to an inner surface 132 of tubular housing 130 and exterior surface 108 of each rigid ring 102. Non-rigid material 110 may also adhere to portions 109 (see, e.g., FIG. 6) of sides 107 that are exposed outside of helical passageway 120 when rigid rings 102 are assembled in the structure of helical passageway 120.

Non-rigid material 110 may include, for example, any suitable deformable elastomeric material (e.g., rubber, plastic, etc.). In some implementation, non-rigid material may include butyl rubber polyamide, polyester, olefin, silicone, styrenics, urethane, and a composite of a thermoplastic and cured rubber. More specific non-limiting examples of non-rigid material 110 include room temperature vulcanization silicone, an uncured ethylene-propylene-diene-monomer (EPDM) blended with polypropylene, a styrene-butadiene-styrene block polymer, a styrene-ethylene-butylene-styrene block polymer, a cured ethylene-propylene-diene copolymer/polypropylene blend, a cured isobutylene isoprene rubber/polypropylene blend, and a cured nitrile butadiene rubber/polyvinylchloride blend. The non-rigid material 110 both bonds rigid rings 102 together as helical passageway 120 and permits radial movement of rigid rings 102 relative to each other and relative to tubular housing 130.

FIG. 5A shows a default position, when rigid rings 102 are assembled in helical passageway 120. For any given longitudinal cross section, exterior surface 108 of a rigid ring 102 is positioned at a radial distance, x, from inner surface 132 of tubular housing 130 and a radial distance, y, from exterior surface 108 of an adjacent rigid ring 102. For example, as shown in FIG. 5A, rigid ring 102-2 is located at a distance, x1, between exterior surface 108-2 and inner surface 132 and a distance, y1, between exterior surface 108-2 and adjacent exterior surface 108-1. When rotor 12 rotates within stator section 100 and solid-free fluids pass through pump section 10, the above x and y distances may generally remain constant.

FIG. 5B shows a solid 20 passing between rings 102 and rotor 12. As rotor 12 pushes the solid 20 against the rigid rings 102, non-rigid material 110 may deform and allow rings 102 to move radially relative to inner surface 132 and relative to each other. For example, as shown in FIG. 5B, rigid rings 102-2 and 102-3 may be temporarily displaced from a default position. Referring specifically to rigid ring 102-2, rigid ring 102-2 may move to a distance, x2, between exterior surface 108-2 and inner surface 132 and a distance, y2, between exterior surface 108-2 and adjacent surface 108-1. Rigid ring 102-3 may be similarly displaced when contacting solid 20.

Radial displacement of rigid rings 102 may allow solid 20 to pass between rotor 12 and rigid rings 102 with less abrasive force than would occur in a rigid stator. In some embodiments, non-rigid material 110 may permit radial displacement of rings 102 relative to tubular housing 130 (e.g., the change from x1 to x2) of at least 0.1 inches (2.54 mm) or more. According to an implementation, the diameter of tubular housing 130, the material properties of non-rigid material 110, and the radial thickness $T_R$ of rigid rings 102 may be configured to prevent y2 from exceeding $T_R$. According to another implementation, a force exerted (e.g. by solid 20) on one rigid ring 102 may cause one or more adjacent rigid rings 102 to also move relative to tubular housing 130. For example, compression of non-rigid material 110 by one rigid ring 102 may cause non-rigid material 110 to radially displace adjacent rings 102 (e.g., applying force at exterior surfaces 108), although to a lesser degree than the ring(s) 102 that is contacting the solid. As shown in FIG. 5B, for example, displacement of ring 102-3 by solid 20 may also cause non-rigid material 110 to draw ring 102-4 away from rotor 12.

The other adjacent rings 102 in helical passageway 120 may prevent torsion or axial movement of radially displaced rigid rings 102. After the solid 20 passes beyond rigid rings 102-2 and 102-3, for example, these rigid rings may be forced back into the default position (e.g., FIG. 5A) by non-rigid material 110. Thus, non-rigid material 110 allows for a dynamic change in radial spacing between the stator rings 102 and rotor 12 during operation of rotor 12.

Figure 7:
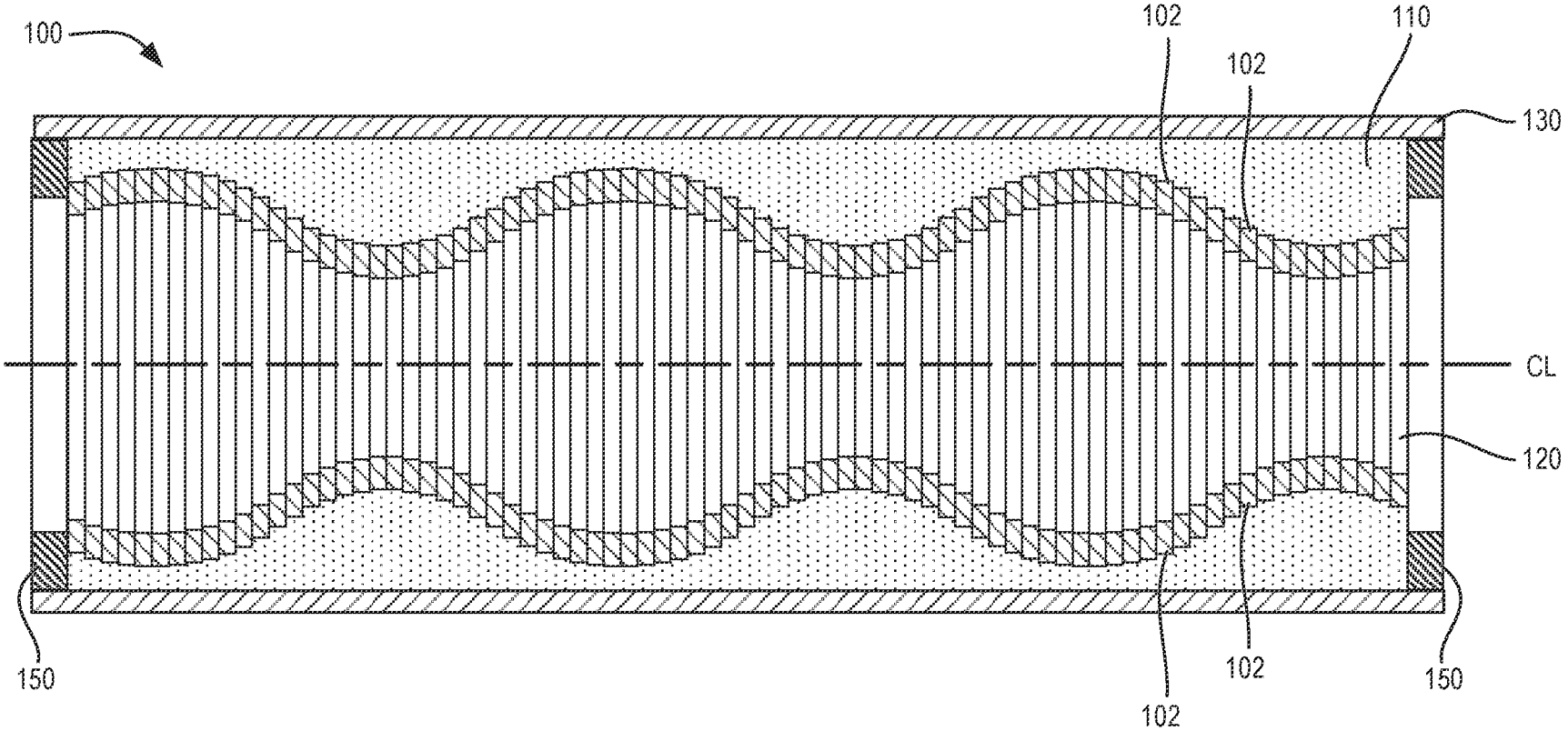
FIG. 7 is a longitudinal cross-section view of the portion of the semi-rigid stator of FIG. 1 with a retention disk installed.
Figure 8A:
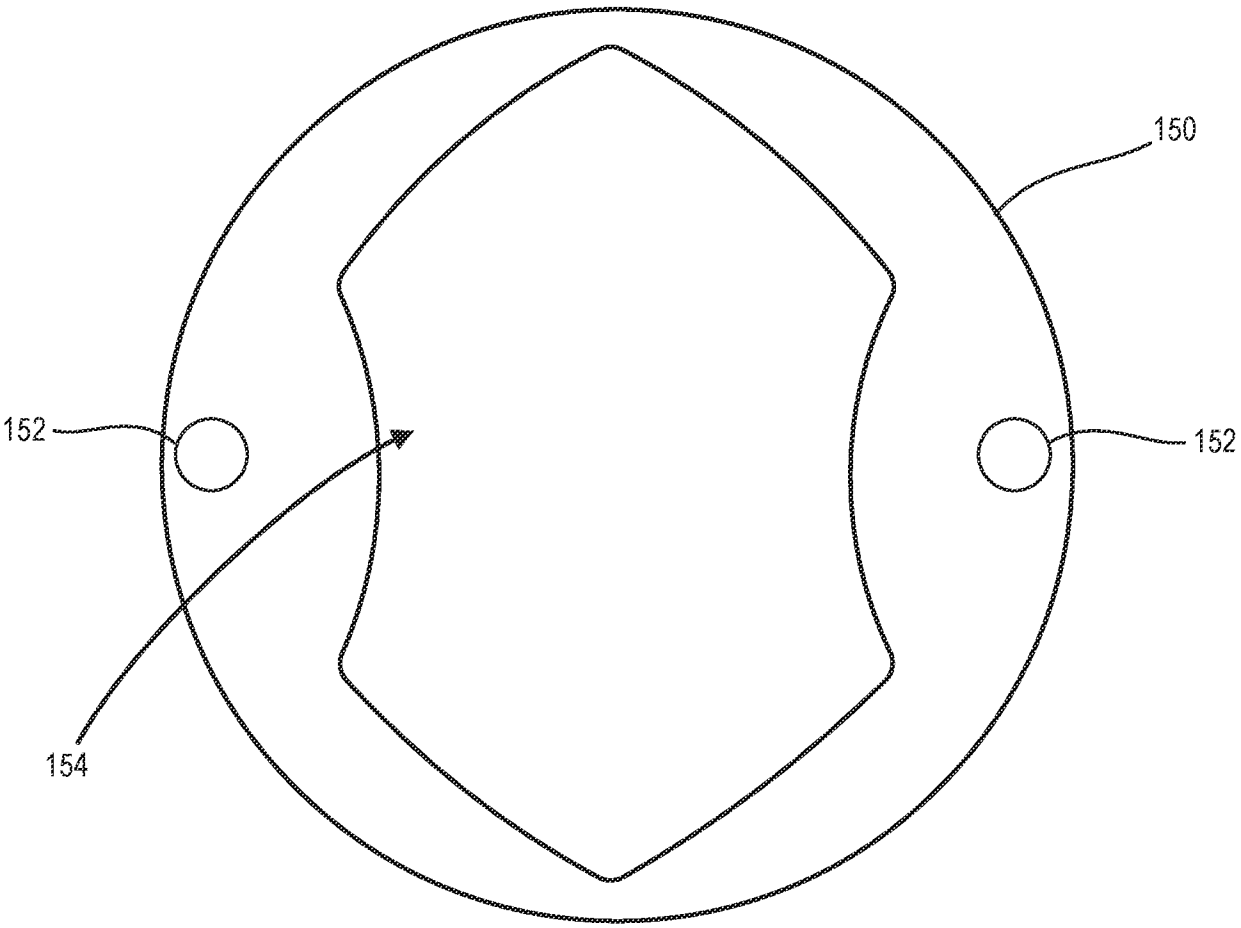
FIG. 8A is an end view of the retention disk of FIG. 7.
Figure 8B:
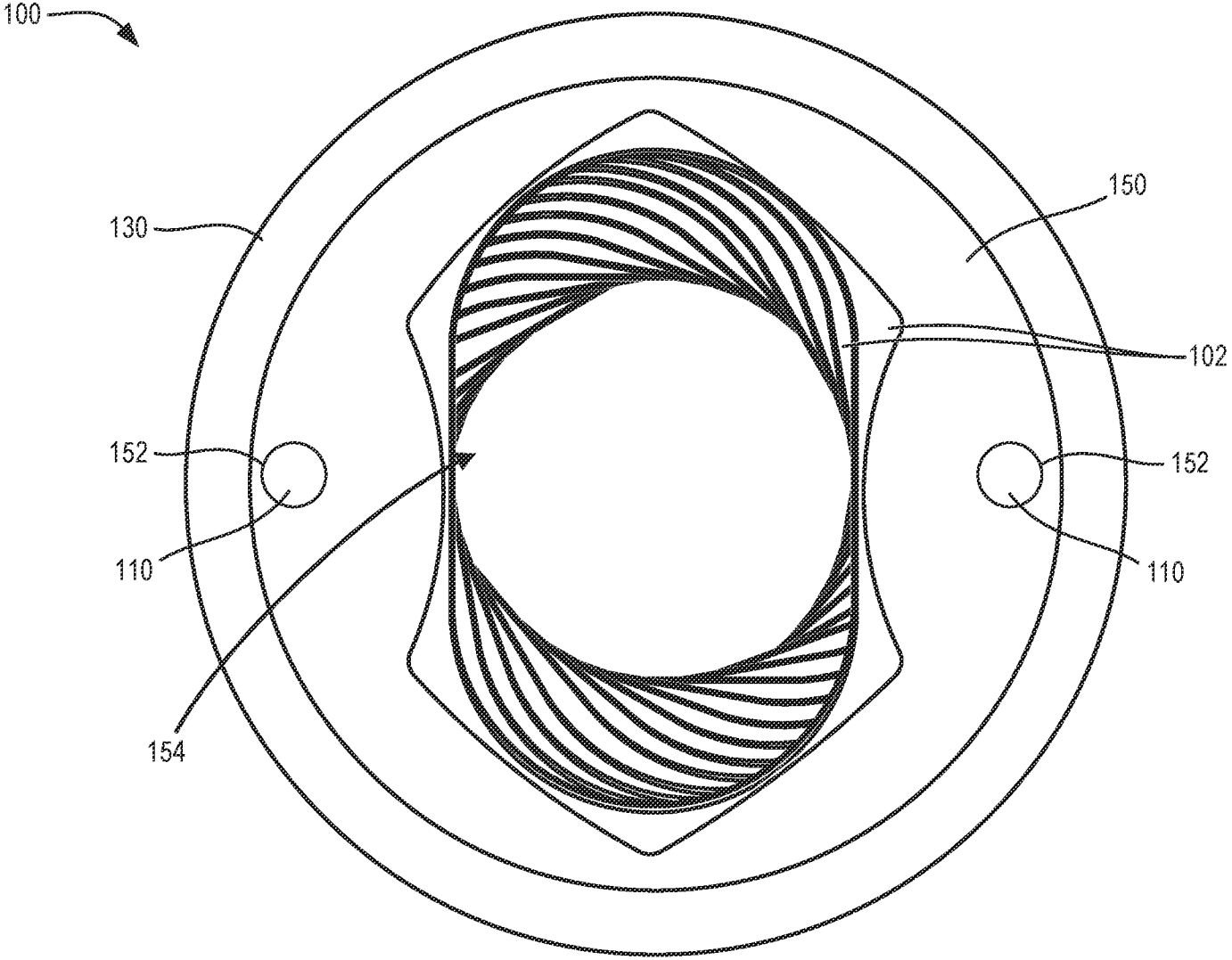
FIG. 8B is an end view of the stator section of FIG. 7 with the retention disk installed.

FIG. 7 depicts a partial, longitudinal cross-sectional view of an exemplary semi-rigid stator section 100, with optional retention disks 150 installed. FIG. 8A is an end view of retention disk 150, and FIG. 8B is an end view of stator section 100 with retention disks 150 installed. Retention disk 150 may have a substantially circular circumference with an opening or aperture 154 that is as large as or larger than opening 104 of rigid ring 102. Retention disk 150 may be bonded to the inside surface 132 of tubular housing 130 by for example, welding, fusing, soldering, brazing, sintering, diffusion bonding, mechanical fastening, or via an adhesive bond.

Retention disk 150 may be positioned to generally prevent movement of rigid rings 102 in an axial direction. Retention disk 150 may also secure non-rigid material 110 within tubular housing 130. Although a retention disk 150 is shown at both ends of tubular housing 130 in FIG. 7, in other implementations, a retention disk 150 may be used at only one end of tubular housing 130 or between sections of helical passageway 120.

According to an implementation, retention disk 150 may include one or more access holes 152. Access holes 152 may be used to inject uncured non-rigid material 110 during assembly of stator section 100. Some access holes 152 may also be used as bleed holes to prevent air entrapment during assembly.

According to one implementation, the shape of aperture 154 may be different than the shape of opening 104. For example, aperture 154 may be asymmetrical and/or include lobes that engage a portion of ring 102 (e.g., parts of side 107) to prevent axial movement while permitting radial movement. The shape of aperture 154 may permit solids (e.g. solid 20, not shown in FIG. 7 or 8) to pass through retention disk 150 when an adjacent rigid ring 102 (e.g., the last ring in helical passageway 120) is displaced.

Figure 9C:
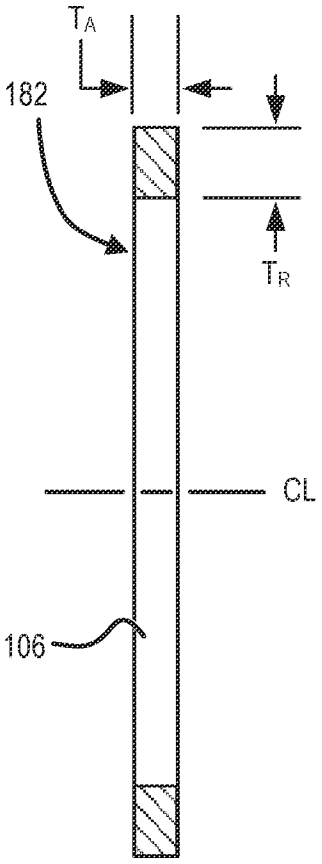
FIGS. 9A-9C are end, side, and side cross-section views of another exemplary stator ring, according to an implementation described herein.
Figure 9B:
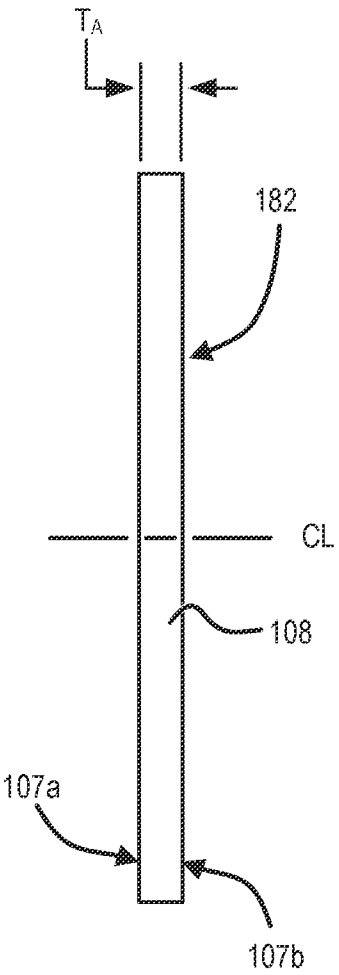
Figure 9A:
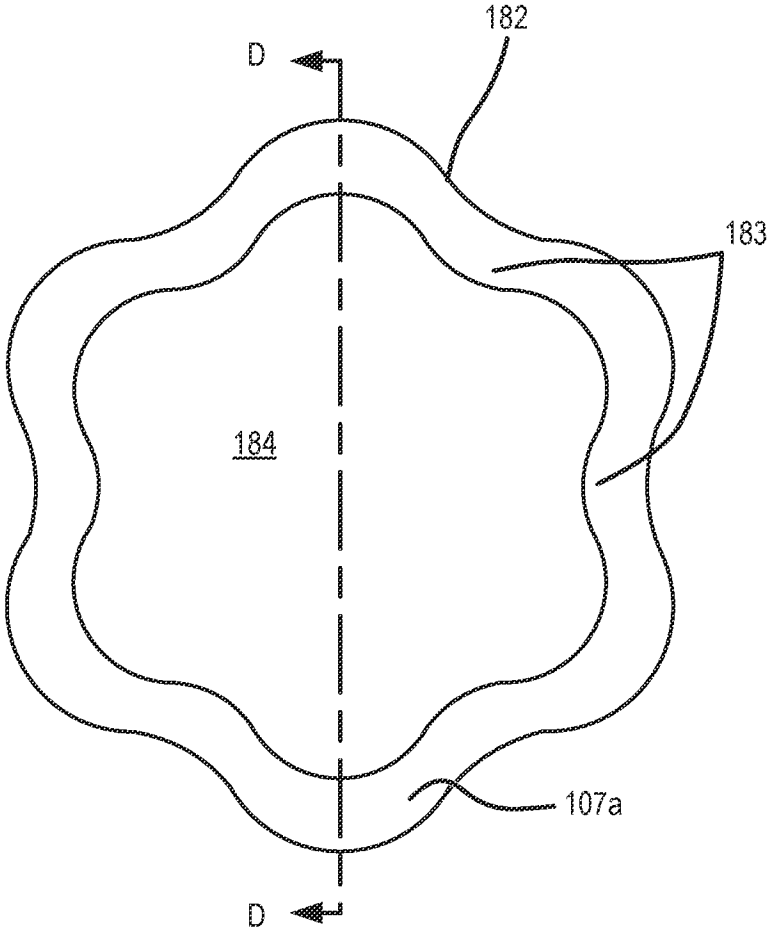

FIGS. 9A and 9B provide end and side views, respectively, of a rigid ring 182 according to another embodiment. FIG. 9C is a side cross-section view of rigid ring 182 along section D-D of FIG. 9A. Each rigid ring 182 includes a convoluted opening 184 with an exemplary ring having a number of equally spaced symmetrical lobes 183 radially extending toward the centerline CL. While six lobes 183 are shown in the configuration of FIGS. 9A-9C (e.g., to accommodate a five-lobe rotor, not shown), other lobe configurations may be used. In one implementation, all of rigid rings 182 have substantially identical construction and dimension. Rigid ring 182 may be implemented as described above in connection with rigid ring 102 to form helical passageway 120.

According to another embodiment, stator section 100 may be formed adjacent to other types of stator sections in pump section 10. For example, stator section 100 may be axially aligned with other stator sections that use an elastically deformable liner in contact with rotor 12 to form a hybrid stator section. The liner may include an elastically deformable elastomeric material, such as rubber, with an even or smooth profile.

In implementations described herein, a semi-rigid stator is provided for a helical gear device. The stator includes a stack of rigid rings, a deformable or non-rigid material, and a rigid housing. Each of the rigid rings includes a central opening and an exterior surface. The rigid rings are aligned along a common centerline and rotated slightly relative to each other such that the stack of rigid rings forms a helically convoluted chamber. The stack of rigid rings is secured within the rigid stator housing by the deformable material disposed between the exterior surface of each of the rigid rings and the rigid housing. The deformable material bonds the rigid rings together as the ring stack and permits movement of the rigid rings relative to each other and relative to the rigid housing.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

Although the invention has been described in detail above, it is expressly understood that it will be apparent to persons skilled in the relevant art that the invention may be modified without departing from the spirit of the invention. Various changes of form, design, or arrangement may be made to the invention without departing from the scope of the invention. Different combinations illustrated above may be combined in a single embodiment. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A stator for a helical gear device, comprising:

a stack of rigid rings, each of the rigid rings including:

a front surface, a rear surface, an interior surface defining a central opening extending from the front surface to the rear surface, and an exterior surface, wherein each of the rigid rings is aligned along a common centerline, and each of the rigid rings is rotated slightly relative to each other such that the stack of rigid rings forms a helically convoluted chamber;

a rigid stator housing, the stack of rigid rings being located within the rigid stator housing; and a deformable layer disposed between the exterior surface of each of the rigid rings and the cylindrical outer housing, wherein the deformable layer bonds the rigid rings together as the ring stack and permits radial displacement of the rigid rings, relative to each other to permit a solid to pass between the rigid rings and a rotor within the stator.

2. The stator of claim 1, wherein the deformable layer is a bonding material that secures the stack of rigid rings to the rigid stator housing.

3. The stator of claim 1, wherein the central opening is non-circular.

4. The stator of claim 1, wherein the central opening includes a plurality of radially inwardly extending lobes.

5. The stator of claim 1, wherein the rigid stator housing is cylindrical.

6. The stator of claim 1, wherein the rigid rings include a metal material.

7. The stator of claim 1, wherein the rigid rings include hardened tool steel.

8. The stator of claim 1, wherein the rigid rings include a ceramic material.

9. The stator of claim 1, wherein the deformable layer permits movement of the rigid rings at least 2 millimeters in a radial direction.

10. The stator of claim 1, wherein the deformable layer allows for a dynamic change in radial spacing between one or more of the rigid rings and the rotor during operation of the rotor.

11. The stator of claim 1, wherein the rigid rings have a radial thickness of at least 1.5 millimeters.

12. The stator of claim 1, wherein the deformable layer is an elastically deformable elastomeric material.

13. The stator of claim 1, wherein the rigid ring has a non-uniform radial thickness.

14. The stator of claim 1, further comprising:

a cylindrical retention disk fixedly attached to at least one end of the stack, the cylindrical retention disk having an opening with a different shape than the central opening of each of the rigid rings.

15. A helical gear device, comprising:

a rotor including one or more radially outwardly extending helical lobes; and a stator including:

a stack of rigid rings, each of the rigid rings having:

a front surface, a rear surface, an interior surface defining a central opening extending from the front surface to the rear surface, and an exterior surface, wherein each of the rigid rings is aligned along a common centerline, and each of the rigid rings is rotated slightly relative to each other such that the stack of rigid rings forms a helically convoluted chamber;

a rigid stator housing, the stack of rigid rings being located within the rigid stator housing; and a deformable layer disposed between the exterior surface of each of the rigid rings and the cylindrical outer housing, wherein the deformable layer bonds the rigid rings together as the ring stack and permits radial displacement of the rigid rings, relative to each other, to permit a solid to pass between the rigid rings and the rotor.

16. The helical gear device of claim 15, wherein the deformable layer permits movement of the rigid rings relative to the rigid housing.

17. The helical gear device of claim 15, wherein the deformable layer allows for a dynamic change in radial spacing between the at least one of the rigid rings and the rotor during operation of the rotor.

18. The helical gear device of claim 15, wherein the deformable layer is a bonding material that secures the stack of rigid rings to the rigid stator housing.

* * * * *